US005135456A

United States Patent [19]

Jones

[11] Patent Number: 5,135,456

[45] Date of Patent: Aug. 4, 1992

[54] LOW ROW EXERCISE MACHINE

[75] Inventor: Gary A. Jones, Falmouth, Ky.

[73] Assignee: Hammer Strength Corporaation, Cincinnati, Ohio

[21] Appl. No.: 691,507

[22] Filed: Apr. 25, 1991

[51] Int. Cl.[5] ..... A63B 21/00

[52] U.S. Cl. ..... 482/133; 482/93; 482/72

[58] Field of Search ..... 272/118, 130, 134, 136, 272/118, 117, 116, 141, 400; 482/73

[56] References Cited

U.S. PATENT DOCUMENTS 4,898,381 11/1991 Gordon ..... 272/117

OTHER PUBLICATIONS

Nautilus Instruction Manual 272/93 Catalog Digest Jun. 14 1979.

Leverage Machines by Nautilus Instruction Manual.

*Primary Examiner*—Richard J. Apley

*Assistant Examiner*—J. Donnelly

*Attorney, Agent, or Firm*—Wood, Herron & Evans

[57] ABSTRACT

A low row exercise machine includes a frame, a seat and chest support connected to the frame along a vertical midplane, and a paiar of levers with first ends pivotally connected to the frame above and in front of an exerciser supported on the seat. Each lever includes an intermediately located hub for holding a selectable weight resitance and a handle located at a second, lower end thereof adapted to be grasped and pulled rearwardly through a low row exercise motion by an exerciser supported on the seat. The levers pivot through planes which converge with respect to the forward facing direction of the exerciser. The orientation of the frame, the seat and the levers, and particularly the convergence of the levers and the angles of connection of the handles with respect to the levers readily accommodate the natural musculoskeletal makeup of the human body during the performance of a low row exercise motion, thus maximizing the muscular benefit attainable through performance of this exercise motion.

20 Claims, 4 Drawing Sheets

LOW ROW EXERCISE MACHINE

FIELD OF THE INVENTION

This invention relates to a low row exercise machine for exercising a muscle group that includes the latissimus dorsi, the rhomboids, the posterior deltoid, the trapezius and the biceps.

BACKGROUND OF THE INVENTION

Many athletes and non-athletes utilize weight lifting or weight training exercises to build strength and/or bulk, to prevent injury, or to improve overall condition and appearance. Typically, weight training exercises are performed with either exercise machines or free weights, i.e., barbells and weighted plates, dumbbells, etc. For various reasons, most exercise programs incorporate both machines and free weights in a variety of different exercise routines in order to maximize the effect of working out a desired number of muscle groups.

Free weights offer a number of advantages over exercise machines. For instance, they are relatively inexpensive in comparison to exercise machines. Free weights are also more versatile because a variety of exercises can be performed with one set of weights, whereas most exercise machines are designed for only one exercise. Even though some exercise machines accommodate more than one exercise, the cost of these machines usually increases proportionately with the number of exercises. Use of dumbbells also enables both arms to be exercised independently. Finally, free weights are popular among many weight lifters because the lifting movements are not restricted to prescribed planes of motion or prescribed angles.

Nevertheless, there are also a number of inherent disadvantages associated with free weights. One such disadvantage relates to safety. Although most weight room instructors strongly advise against an individual performing weight training exercises alone, this cautionary measure is particularly important when the lifting of free weights is involved. This is due to commonly recognized dangers such as the possibility of dropping a weight on a body part, or becoming trapped beneath a bar, which could easily occur in exercises such as bench press, incline press or squat. Additionally, through carelessness, loading and unloading of heavy weighted plates onto the ends of a bar sometimes results in an unbalanced bar that falls downward from a rack.

Another danger associated with some free weight exercises relates to the body positioning required to perform a prescribed maneuver. For instance, the most efficient way to perform an exercise referred to as a low row exercise is with a weighted barbell or dumbbells held in the hands, in front of the body, with the back bent and arms extended downwardly. The barbell is pulled upwardly toward the chest. This free weight, low row exercise is beneficial from a purely muscular viewpoint. However, it is also dangerous and/or awkward because of the position of the body with respect to the barbell during the exercise maneuver. The required bending of the back places the lower back muscles and the spine in a particularly vulnerable position during performance of this exercise in the described manner.

It might be said that the potential for injury from performing a low row exercise with free weights far outweighs the attainable muscular benefits. For this reason, many individuals simply do not perform this exercise.

Another disadvantage associated with this exercise relates to the fact that the weight resistance, or opposing force that is exercised against, is always directed vertically downward by gravity. This limits the manner in which the weight resistance may be applied to the low row muscle group during the prescribed muscular movement. The resistance acted against throughout the motion does not correlate in any way to the strength curve for the low row muscle group.

While the benefit of performing a free weight low row exercise may be questionable, it also seems that the relatively high cost of exercise machines has effectively diminished the incentive to design and develop an exercise machine dedicated solely to exercising the low row muscle group in an effective, injury-free manner. As a result, although many exercise machines do provide some tangential muscular benefit for the low row muscle group, none are designed specifically for the purpose of optimally isolating the low row muscle group to maximize muscular benefit.

It is an object of this invention to provide a low row exercise machine which simulates exercise with free weights but without the disadvantages normally associated therewith.

It is another object of this invention to provide an exercise machine which optimally isolates the low row muscle group to maximize muscular benefit during performance of a low row movement.

SUMMARY OF THE INVENTION

This invention contemplates a low row exercise machine with a frame, a seat and chest support connected to the frame along a vertical midplane and a pair of levers pivotally connected to the frame in front of the seat. Each lever has an upper end pivotally connected to the frame above and in front of the seat, an intermediate hub for holding a preselected weight resistance and a handle at a lower end adapted to be grasped and pulled rearwardly in a low row exercise motion by an exerciser supported on the seat. The levers pivot through planes which converge with respect to the forward facing direction of the seat.

Movement of the levers through a low row, arcuate and upward exercise motion exercises a muscle group which includes the latissimus dorsi, the rhomboids, the posterior deltoid, the trapezius and the biceps. This low row exercise machine provides maximum muscular benefit for this muscle group in a manner which is safe and efficient. Moreover, this low row exercise machine simulates a free weight exercise because the levers move through forwardly converging planes which accommodate the natural musculoskeletal makeup of the human body.

More particularly, the natural musculoskeletal makeup of the body is accommodated by the structural orientation of the levers, the lever axes of pivotal movement and the handles connected to the levers. The particular combination of all of these structural aspects results in a machine which, based upon feedback from a number of individuals involved in the field of strength training, more naturally couples the muscular exertion of the low row exercise motion against a preselected weight resistance and in a direction of motion that is compatible with the musculoskeletal structural makeup of the body.

Because it has two independently pivotal levers, this low row exercise machine enables the performance of either simultaneous or alternate exercise of both arms. This feature is particularly advantageous in monitoring rehabilitation progress after an injury, where it is often necessary to compare the relative strengths of the arms.

In a related aspect of this feature, the angle of connection of the sections of the lever and the location of the weight supporting hub are substantially counterbalanced. As a result, for each lever, the total moment arm about the lever pivot axis is close to zero when no weights are on the hub. The minimum weight that must be exercised against, i.e., with no weight plates supported, is very low. Therefore, and also because the bearings that support the pivotal levers have substantially no friction, weights supported on the levers closely approximate the actual weight resistance that is exercised against, a feature that is not always true of many cam and chain or pulley exercise machines. This feature becomes important during the initial stages of rehabilitation, when it may be required to exercise against very low weight resistance and keep highly accurate records of actual weight lifted.

In accordance with a preferred embodiment of the invention, a low row exercise machine includes a frame, a seat and chest support connected to the frame along a vertical midplane and a pair of levers having upper ends pivotally connected to the frame on opposite sides of the midplane. Intermediate portions of the levers include hubs for holding weighted plates. Handles connected at angles to the lower ends of the levers provide natural grasping positions for coupling applied, low row pulling force along two planes of lever motion which converge with respect to the forward facing direction of the seat. Stops mounted on the levers coact with the frame to limit further downward pivotal movement of the levers.

The outer vertical planes of pivotal movement naturally accommodate the structure of the human body relative to the pulling motion utilized in a low row motion. As a result, a person supported on the seat is able to maximize the muscular benefits attainable by performing a low row exercise, while minimizing joint stress. Use of this invention provides exercise for the low row muscle group in a manner that does not stress joints or skeletal structure associated with this muscle group.

The structural orientation of this low row exercise machine evolved from applicant's belief that most exercise machines oversimplify the musculoskeletal movements of the human body. While his accumulated years of observing and analyzing athletic movements of the body led him to conclude that most musculoskeletal movements are rather complex and involve multiple joints and multiple degrees of freedom, he also recognized that most exercise machines require bodily movement in directions or planes that are oriented simply at right angles or parallel to the torso of the body. Based on these observations, and bolstered by his opinion that the ultimate objective of any exercise machine is to provide maximum muscular benefit with minimum joint stress, applicant perceived a need for improvement in the design of exercise machines and began working toward that goal. Feedback from athletes who have used this low row exercise machine has confirmed that it constitutes a marked improvement over pre-existing machines or free weight methods for performing a low row exercise.

This low row exercise machine provides the benefits of both free weight exercise and exercise with weight machines, while avoiding the attendant disadvantages commonly associated with these methods of exercising.

With this machine, the moment arm about the pivot point is lowest upon initiation of the pulling motion, then the moment arm increases to a maximum and then finally, the moment arm decreases somewhat. This "resistance curve" is produced by the initial starting angle of the weight supporting segment of the levers. It is believed that this resistance curve substantially matches the strength curve of the low row muscle group, and that this feature enables this low row exercise machine to maximize muscular benefit attainable during performance of a low row motion.

These and other features of the invention will be more readily understood in view of the following detailed description and the drawings in which:

DETAILED DESCRIPTION OF THE DRAWINGS

Figure 1:
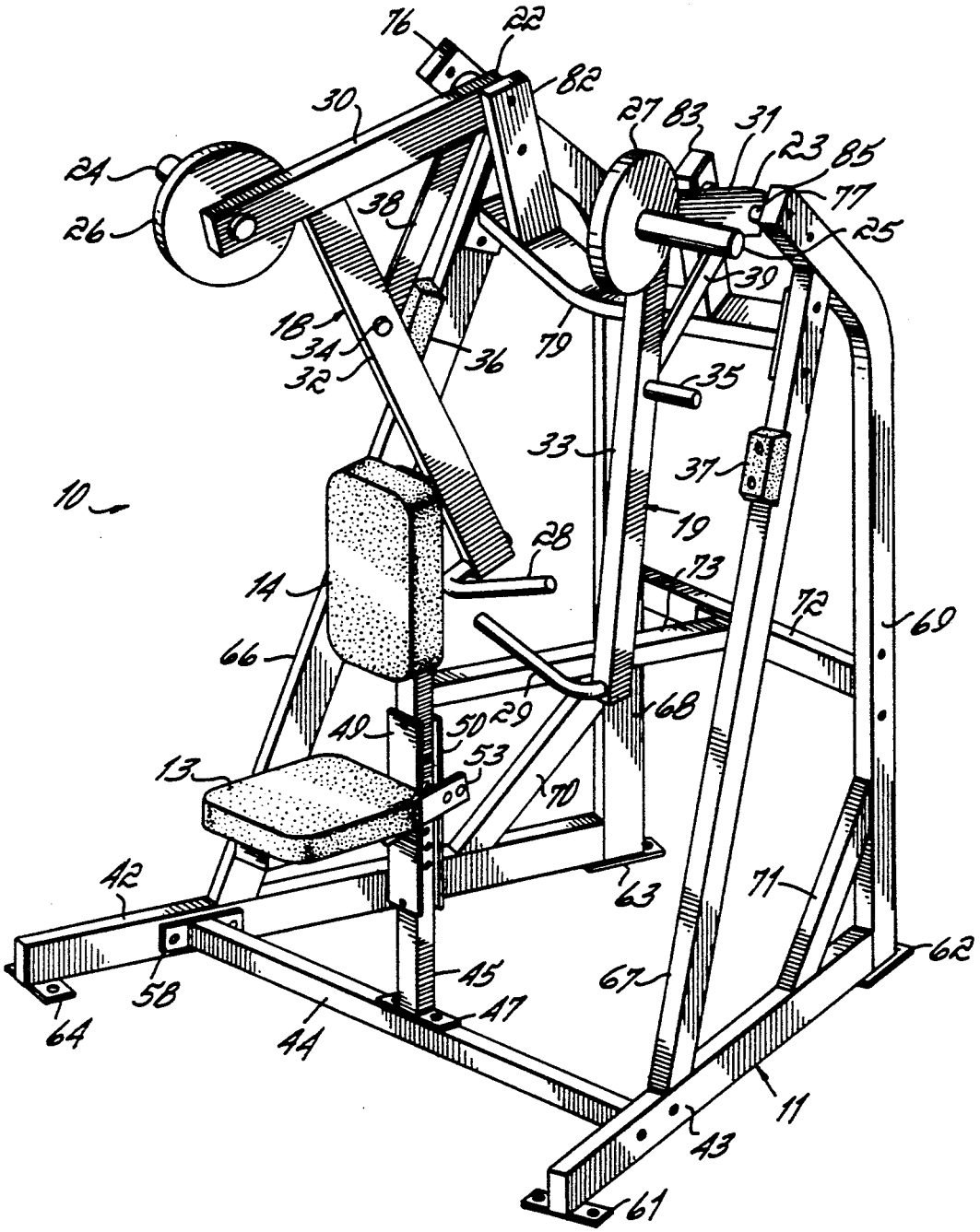
FIG. 1 is a perspective view of a low row exercise machine in accordance with a preferred embodiment of the invention.

FIGS. 1–4 show a low row exercise machine 10 in accordance with a preferred embodiment of the invention. This machine 10 includes a frame 11 made of a number of straight and/or curved sections of heavy duty steel that are either welded or bolted together, or pivotally connected. Overall, the front to back dimension of the machine 10 is about 52", the width is about 57", and the height is about 64". A seat 13 and a chest support 14 are connected to the frame 11 along a vertical midplane 16 (best shown in FIG. 2) which bisects the machine 10. The machine 10 is symmetric with respect to the vertical midplane 16. Generally, in this description, even numbers are used to designate parts on the left side of the midplane 16, and odd numbers are used to designate parts on the right side of the midplane, as viewed looking forwardly from seat 13 in FIG. 1.

Levers 18 and 19 are connected to the frame 11 on opposite sides of the midplane 16, and located in front of the seat 13 and chest support 14. Levers 18 and 19 have first ends 22 and 23, respectively, which are pivotally connected to the frame 11. Each lever includes an intermediately located hub for supporting one or more weighted plates, and a handle connected at an angle to a lower end thereof. As shown in FIG. 1, lever 18 includes hub 24 which supports weight 26, and handle 28 is adapted to be grasped and pulled by an exerciser (not shown) supported on the seat 13 during a low row exercise motion. Lever 19 includes hub 25 which supports weight 27, and handle 29. More particularly, each lever is made up of upper and lower connected metal segments. Lever 18 includes upper segment 30 and lower segment 32, while lever 19 includes upper segment 31 and lower segment 33. The angle of connection between the upper and lower segments of levers 18 and 19 is preferably about 80°.

Levers 18 and 19 further include outwardly extending stops 34 and 35, respectively which coact with pads 36 and 37, respectively, mounted on the frame 11 to restrict further downward pivotal motion of the levers when in an at rest position. For additional structural support, each of the levers also includes a brace which spans diagonally between the first and second segments. Lever 18 includes brace 38, and lever 19 includes brace 39.

The frame 11 of the machine 10 further includes side bottom pieces 42 and 43 and center bottom piece 44. Upright 45 extends upwardly from center bottom piece 44. Upright 45 supports seat 13 and chest support 14. Preferably, connection between upright 45 and center bottom piece 44 is by bolting of a plate 47 welded to a bottom end of the upright 45. The seat 13 is vertically adjustable along upright 45. To provide adjustability, parallel surfaces 49 and 50 sandwich the front and back surfaces of upright 45, and these surfaces frictionally engage parallel, spaced bars connected transversely between forwardly extending connectors 52 and 53 (FIG. 2) which support the bottom of seat 13.

Center bottom piece 44 is preferably connected at its outermost end by bolts to bottom pieces 42 and 43 via plates 58 and 59 welded at forwardly converging angles. The four outermost corners of the frame 11 are also supported on similarly sized plates 61, 62, 63 and 64, which facilitate secured placement of the machine 10 in an exercise room, or during transportation.

Each side of the frame 11 includes a straight, rear leg rigidly connected at a forwardly extending angle and a front leg rigidly connected at a rearwardly extending angle. As shown in FIG. 1, rear leg 66 and front leg 68 are located on one side of the machine 10, and rear leg 67 and front leg 69 are located on an opposite side of the machine 10. Diagonal braces 70 and 71 extend between the respective bottom piece and front legs of the machine. An intermediate brace 72 extends horizontally between front legs 68 and 69 and a center support 73 extends between the intermediate brace 72 and upright 45.

Upper portions of front legs 68 and 69 bend rearwardly toward the respective rear legs 66 and 67. Upper ends of the rear legs are welded to the bottom surfaces of the rearward bent portions of the front legs. Uppermost portions 76 and 77 of front legs 68 and 69 extend beyond the tops of the welded rear legs 66 and 67, respectively. A forwardly and downwardly curved brace 79 extends between the tops of rear legs 66 and 67. Preferably the angle of bend of the curved brace 79 is about 145°, as shown best in FIG. 2. Rearwardly and upwardly extending members 82 and 83 are welded to the top surface of curved brace 79, and members 82 and 83 are located opposite from inwardly directed surfaces of uppermost portions 76 and 77, respectively. Axles 84 and 85 extend horizontally between uppermost portion 76 and member 82 and uppermost portion 77 and member 83, respectively, and the axles are connected thereto at their ends by bearings (not shown). Preferably, the bearings used are pillow block bearings sold by Browning, Part No. VF2S16. These bearings require maintenance only once a year, maintenance which consists of one shot of lubricating oil per year. Axles 84 and 85 are rigidly secured to upper segments 30 and 31, respectively, of levers 18 and 19.

Figure 2:
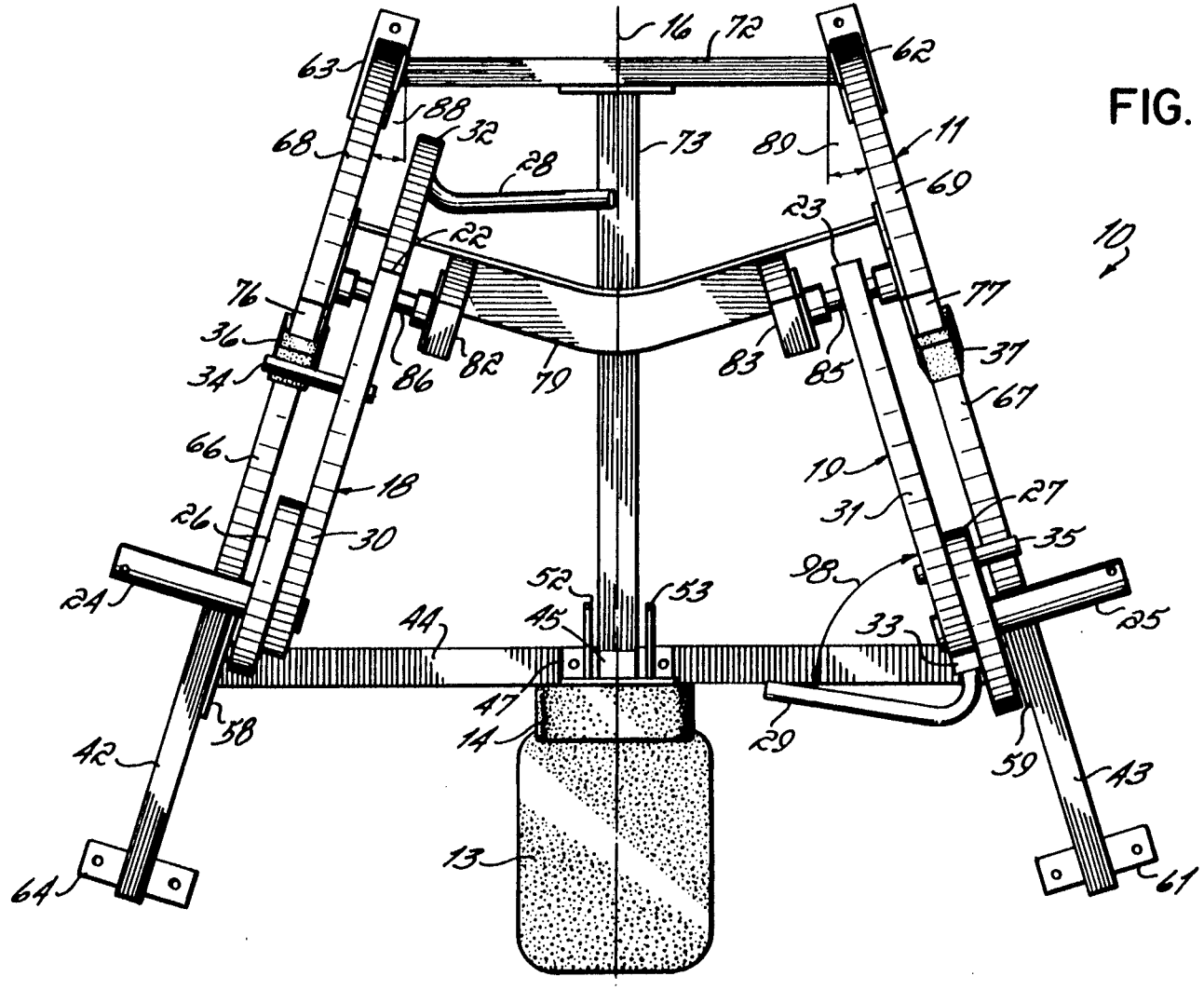
FIG. 2 is a plan view of the low row exercise machine shown in FIG. 1.

Each of the axles is oriented perpendicular with an outer plane of vertical motion through which a respective lever moves when it is pulled by the exerciser. This is most clearly shown in FIG. 2. Angles 88 and 89 designate the angles of convergence of the sides of the frame 11 with respect to the forward facing direction of the seat 13 and chest support 14. This angle is preferably about 17°. As described previously, the convergence of the outer planes of lever movement more naturally accommodate the musculoskeletal makeup of the human body during performance of a low row exercise motion. FIG. 2 also shows the angle of connection of each of the handles 28 and 29 to its respective lever 18 or 19. Preferably, each handle is made of metal and curved at one end which is then welded within a recess at the lower end of a respective lever. Opposite ends of the handles angle upwardly and forwardly with respect to the frame so that the handles are not perpendicular to the bottoms of the levers. Each handle is bent at an angle of about 80°, an angle designated by numeral 98 and shown best in FIG. 2. The free end of each lever is displaced angularly downwardly from the respective lower segment at an angle of about 80°, an angle designated by numeral 99 and shown best in FIG. 4.

Figure 3:
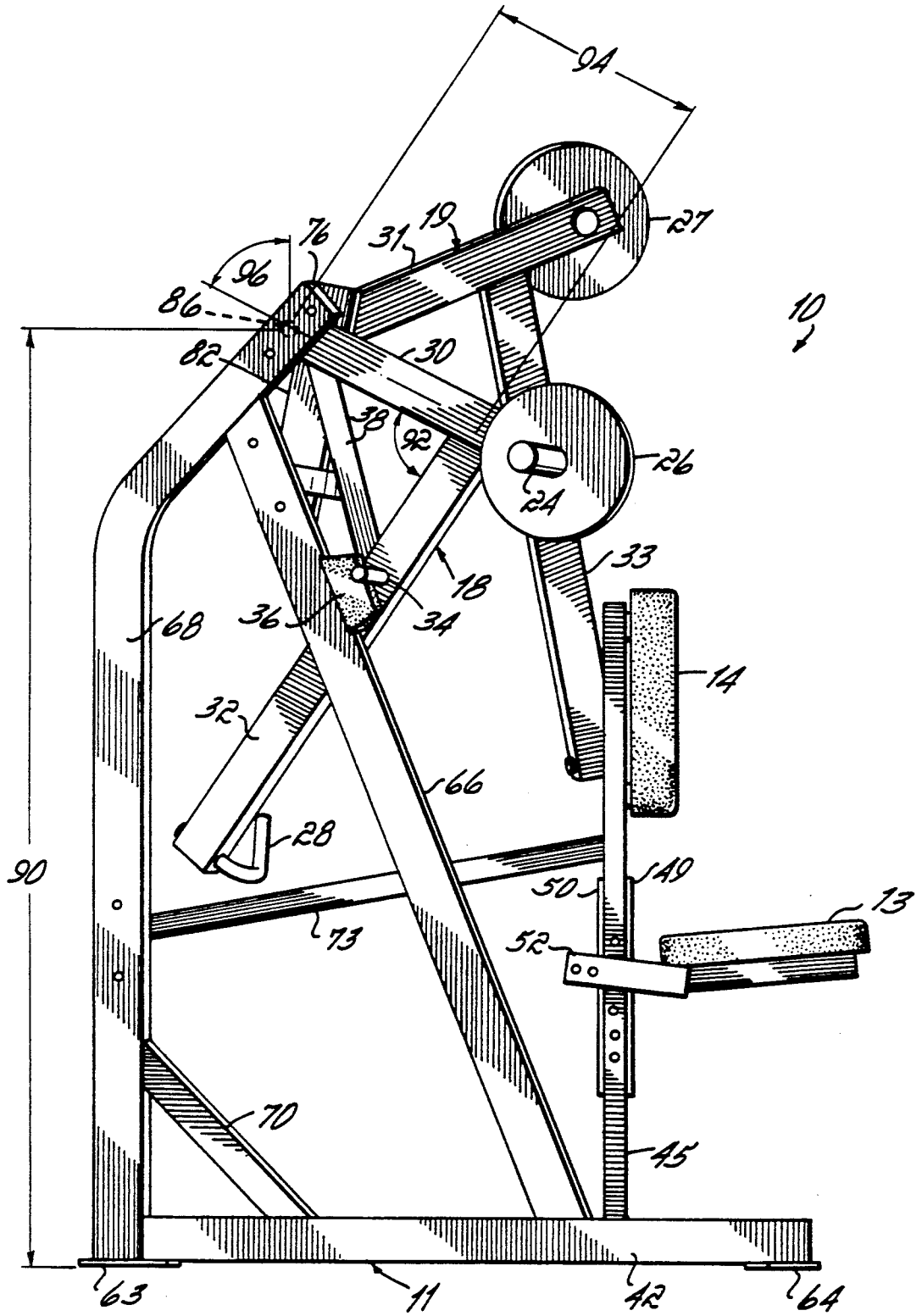
FIG. 3 is a side view of the low row exercise machine shown in FIG. 1.

FIG. 3 shows a side view of the low row exercise machine 10 in accordance with a preferred embodiment of the invention. Numeral 90 designates the vertical distance between bottom piece 42 and axle 84, a distance which is preferably about 59½". FIG. 3 also shows the preferable angle of connection between upper segment 30 and lower segment 32 of lever 18. This angle is designated by numeral 92 and, as mentioned previously, is preferably about 80°. Upper segment 30 has a preferable length of about 23", and lower segment 32 has a preferable length of about 32½". The distance along upper segment 30 between axle 84 and the location of connection with lower segment 32 is designated by numeral 94, and is preferably about 16½". When in an at rest position, lever 18 is situated such that upper segment 30 resides at an angle of about 65° displaced from vertical, an angle designated by numeral 96.

The initial starting angle, the lengths of the upper and lower segments and the angle of connection therebetween combine to provide a lever 18 which feels unweighted when there are no plates on the hub. As a result, as explained earlier, this facilitates exercise of very low weights, and is particularly useful during rehabilitation of an injury. It also provides a lever 18 which has its minimum moment arm upon initiation of pulling during a low row exercise. The moment arm increases until segment 30 is horizontal, and then it decreases again. Lever 19 utilizes the same structural orientation as lever 18.

Figure 4:
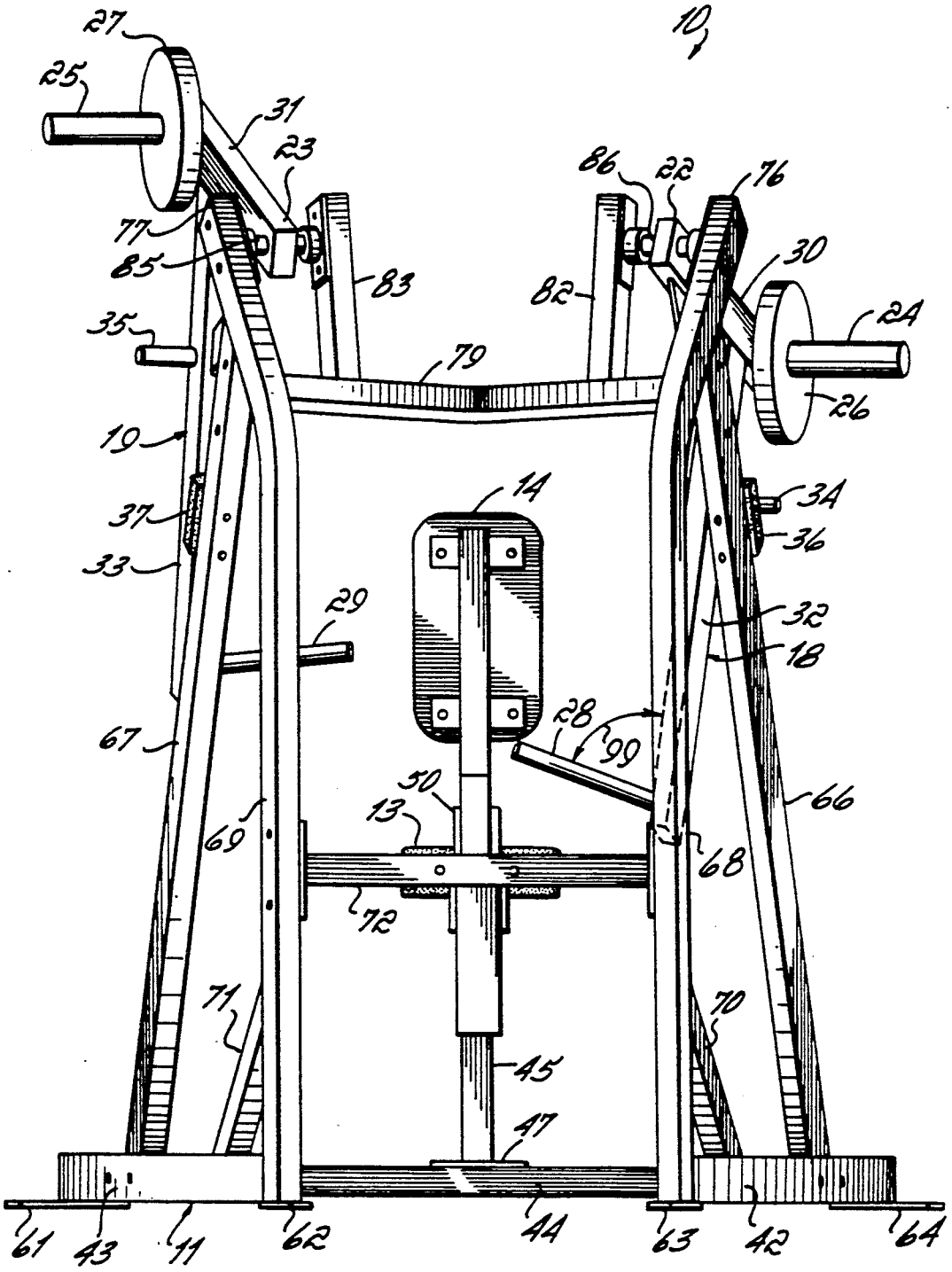
FIG. 4 is a front view of the low row exercise machine shown in FIG. 1.

Because this machine 10 utilizes two independently pivotable levers 18 and 19, independent exercise of both arms through a low row exercise motion is possible. FIG. 4 shows a front view of the exercise machine 10 in accordance with a preferred embodiment of the invention.

While a preferred embodiment of the invention has been described, it is to be understood that the invention is not limited thereby and that in light of the present disclosure, various other alternative embodiments will be apparent to a person skilled in the art. For instance, the structural orientation of some parts or portions of the frame 11 is not critical, so long as the positioning of the lever pivot points, the lengths of the lever sections, handles, the seat and chest support and the vertical planes of motion are maintained. Additionally, while the particular angles shown in this application are considered to be optimum at this point in time, based upon feedback from those involved in strength training, it is entirely possible that some further refinements may evolve. Accordingly, it is to be understood that changes may be made without departing from the scope of the invention as particularly set forth and claimed.

I claim:

1. A low row exercise machine comprising:

a frame;

a seat connected to the frame along a vertical midplane and adapted to support an exerciser in a forward facing direction; and a lever having a first end pivotally connected to the frame in front of and above the seat, the lever also including weight supporting means adapted for holding a selectable weight resistance, the lever further having a second end adapted to be grasped by the hand of an exerciser supported on the seat and pulled toward the seat in a low row exercise motion, the second end adapted to be grasped so that the thumb of the hand is directly generally inwardly toward the midplane and the palm of the hand is directed generally downwardly, the lever being pivotal through a plane of motion which converges with respect to the forward facing direction of the seat so that the hand moves away from midplane when pulled toward the seat.

2. The low row exercise machine of claim 1 wherein said pivotal plane of motion converges at an angle of about 17°.

3. The low row exercise machine of claim 1 and further comprising:

a chest support connected to the frame in front of the seat to support the chest of the exerciser during performance of a low row exercise.

4. The low row exercise machine of claim 1 and further comprising:

a handle connected to the second end of the lever at an angle other than 90°.

5. The low row exercise machine of claim 4 wherein the lever further comprises:

a first segment having upper and lower ends, the upper end pivotally connected to the frame and weight supporting means located at the lower end; and a second segment rigidly connected to the first segment between said upper and lower ends, and the handle connected to a bottom end of the second segment.

6. The low row exercise machine of claim 5 wherein said second segment further includes an outwardly extending stop adapted to coact with the frame to limit downward pivotal motion of the lever with respect to the frame.

7. The low row exercise machine of claim 1 wherein said weight support means comprises a hub rigidly connected to the lever.

8. The low row exercise machine of claim 1 wherein the seat is vertically adjustable with respect to the frame.

9. The low row exercise machine of claim 1 and further comprising:

a second lever pivotally connected to the frame and symmetric with the first lever with respect to the vertical midplane.

10. The low row exercise machine of claim 9 wherein both levers pivot through planes of motion which converge at angles of about 17° with respect to the forward facing direction of the seat.

11. A low row exercise machine comprising:

a frame;

a pad connected to the frame along a vertical midplane and adapted to support an exerciser in a forward facing direction;

a pair of levers located on opposite sides of the midplane, each lever including a first end pivotally connected to the frame above and in front of the pad, each lever further including an intermediately connected hub adapted to hold a selectable weight resistance and a handle at a second end thereof, below the pad, adapted to be grasped and pulled in a low row exercise motion by the hand of an exerciser supported by a rearwardly directed surface of the pad, each handle adapted to be grasped so that the thumb of the respective hand is directed generally inwardly toward the midplane and the palm of the hand is directed generally downwardly, the levers pivotal through outer planes of motion which converge toward the midplane with respect to the front of the pad so that the hands move away from the midplane when pulled toward the seat.

12. The low row exercise machine of claim 11 and further comprising:

a seat connected to the frame behind the pad for supporting the exerciser during performance of the low row exercise.

13. The low row exercise machine of claim 12 wherein the seat is vertically adjustable.

14. The low row exercise machine of claim 11 wherein the outer planes of pivotal motion converge at angles of about 17°.

15. The low row exercise machine of claim 11 wherein each of the lever handles is connected to a respective second end at an angle other than 90°.

16. The low row exercise machine of claim 11 wherein each lever further includes:

an upper segment pivotally connected to the frame and adapted to support a hub and a lower segment connected to the upper segment at an angle and adapted to support the respective handle; and a brace segment connected between said first and second segments.

17. The low row exercise machine of claim 16 wherein each lever further includes an outwardly extending stop located on a lower segment thereof adapted to coact with the frame to limit downward pivotal movement of the respective lever with respect to the frame.

18. The low row exercise machine comprising:

a frame;

a seat and support connected to the frame along a vertical midplane; and a pair of low row exercise means, each low row exercise means pivotally connected to the frame on opposite sides of the midplane above and in front of the seat and support, each pair of low row exercise means including a handle located below the support and adapted to be grasped and pulled rearwardly toward the support in a low row exercise motion by the hand of an exerciser seated on the seat and supported against the support, each handle adapted to be grasped so that the thumb of the respective hand is directed generally inwardly toward the midplane and the palm of the hand is directed generally downwardly, pivotal movement of each low row exercise means occurring in a plane which converges with respect to the forward facing direction of the seat so that the hands move away from the midplane when pulled toward the seat.

19. The low row exercise machine of claim 18 wherein each low row exercise means further includes a handle connected to a lower end thereof at an angle other than 90° to accommodate natural musculoskeletal makeup of a person performing a low row exercise.

20. The low row exercise machine of claim 18 wherein the outer planes of pivotal movement converge with respect to the forward facing direction of the seat at angles of about 17°.

* * * * *